US009452609B2

(12) United States Patent
Myers

(10) Patent No.: US 9,452,609 B2
(45) Date of Patent: Sep. 27, 2016

(54) PARTIAL FILL INK CARTRIDGES

(75) Inventor: John A Myers, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1017 days.

(21) Appl. No.: 12/992,289

(22) PCT Filed: May 13, 2008

(86) PCT No.: PCT/US2008/063506

§ 371 (c)(1),
(2), (4) Date: Feb. 10, 2011

(87) PCT Pub. No.: WO2009/139769

PCT Pub. Date: Nov. 19, 2009

(65) Prior Publication Data

US 2011/0122208 A1 May 26, 2011

(51) Int. Cl.
*B41J 2/175* (2006.01)

(52) U.S. Cl.
CPC ..... *B41J 2/1752* (2013.01); *B41J 2/17513* (2013.01); *B41J 2/17553* (2013.01); *B41J 2/17556* (2013.01)

(58) Field of Classification Search
CPC ..... B41J 2/17513; B41J 2/17553
See application file for complete search history.

(56) References Cited

U.S. PATENT DOCUMENTS

| | | | | |
|---|---|---|---|---|
| 5,489,932 | A * | 2/1996 | Ceschin et al. | 347/87 |
| 5,812,155 | A * | 9/1998 | Seccombe | 347/6 |
| 5,872,584 | A * | 2/1999 | Hauck et al. | 347/86 |
| 5,903,294 | A * | 5/1999 | Abe et al. | 347/87 |
| 5,997,121 | A * | 12/1999 | Altfather et al. | 347/7 |
| 6,276,785 | B1 * | 8/2001 | Shinada et al. | 347/86 |
| 6,595,711 | B2 * | 7/2003 | Hill | 400/470 |
| 6,773,099 | B2 * | 8/2004 | Inoue et al. | 347/86 |
| 6,783,219 | B2 * | 8/2004 | Lui et al. | 347/86 |
| 6,799,842 | B2 * | 10/2004 | Barinaga et al. | 347/85 |
| 7,210,772 | B2 * | 5/2007 | Sasaki | 347/86 |
| 2002/0191058 | A1 * | 12/2002 | Anderson et al. | 347/86 |
| 2003/0048338 | A1 * | 3/2003 | Qingguo et al. | 347/86 |
| 2005/0068387 | A1 * | 3/2005 | Qingguo et al. | 347/86 |
| 2006/0221153 | A1 * | 10/2006 | Kojima et al. | 347/86 |

FOREIGN PATENT DOCUMENTS

| | | | |
|---|---|---|---|
| CN | 1182680 | A | 5/1998 |
| CN | 1706649 | A | 12/2005 |
| EP | 1219447 | A2 | 7/2002 |
| EP | 1258359 | A1 | 11/2002 |
| EP | 1604831 | A2 | 12/2005 |

OTHER PUBLICATIONS

EP Search Report dated Apr. 14, 2011 for European Application No. 08755374.9.

* cited by examiner

*Primary Examiner* — Stephen Meier
*Assistant Examiner* — John P Zimmermann
(74) *Attorney, Agent, or Firm* — HP Inc. Patent Department

(57) ABSTRACT

In one embodiment, an ink cartridge comprises an outer housing that defines an interior space adapted to contain ink and an air vent adapted to enable air to pass into and out of the interior space and a dividing wall provided within the interior space, the dividing wall separating the interior space into a first chamber and a second chamber, the dividing wall defining a passage through which air within the first chamber can pass into the second chamber and out of the cartridge through the air vent when the air within the first chamber expands.

20 Claims, 5 Drawing Sheets

PARTIAL FILL INK CARTRIDGES

BACKGROUND

Ink cartridges for use in inkjet printers are often completely filled with ink during manufacturing such that little or no air is present within the cartridge. Recently, however, it has been proposed to offer for sale partially filled ink cartridges as a lower cost option for customers.

A potential problem with partially filled ink cartridges relates to changes in pressure after the cartridge has been put into use. For example, if the customer installs a partially filled ink cartridge into his or her printer and then transports that printer to a higher altitude location, the reduced atmospheric pressure of the higher altitude causes the air within the cartridge to expand. If that air cannot escape from the cartridge, it can apply pressure to the ink contained within the cartridge and cause that ink to leak or "drool" out of the cartridge.

BRIEF DESCRIPTION OF THE DRAWINGS

The disclosed ink cartridges can be better understood with reference to the following drawings. The components in the drawings are not necessarily to scale.

DETAILED DESCRIPTION

As described above, partially filled ink cartridges can be susceptible to ink leakage or "drool" due to changes in atmospheric pressure. Described in the following are ink cartridges that are resistant to such drool.

Figure 1:
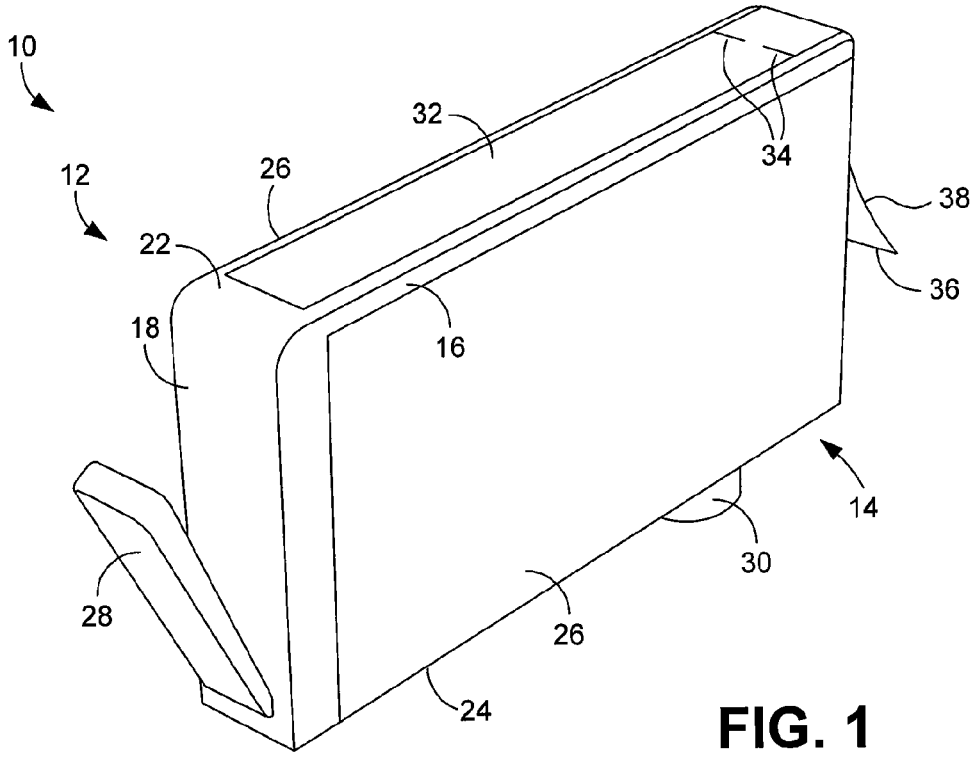
FIG. 1 is a front perspective view of an embodiment of a partial fill ink cartridge.
Figure 2:
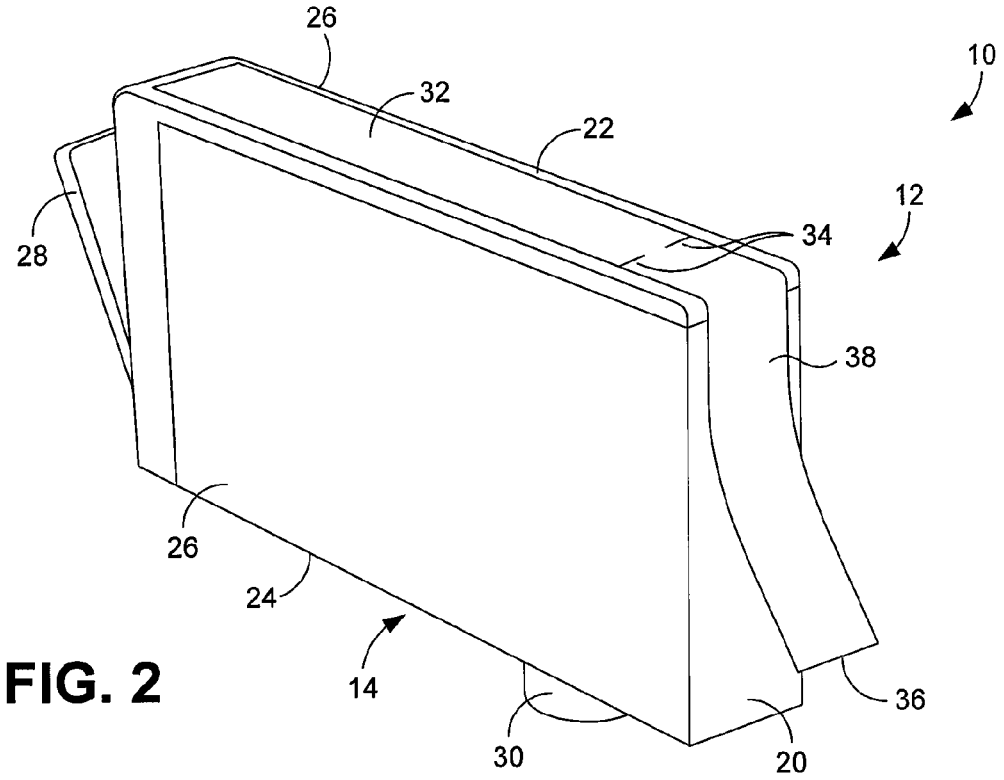
FIG. 2 is a rear perspective view of the ink cartridge of FIG. 1.

Turning to the figures, in which like numerals identify corresponding parts, illustrated in FIGS. 1 and 2 is an embodiment of an ink cartridge 10 that is configured to contain and supply ink to a printing device, such as a printer. As indicated in those figures, the ink cartridge 10 comprises an outer housing 12 formed by a body 14 and a lid 16. The housing 12 defines a front side 18, a rear side 20 (FIG. 2), a top side 22, a bottom side 24, and opposed lateral sides 26. Extending upward from the bottom end of the front side 18 is a finger tab 28 that may be used to insert the cartridge 10 into and/or remove the cartridge from a printing device.

Extending downward from the bottom side 24 is an ink outlet 30 from which ink may be drawn from the cartridge 10.

With further reference to FIGS. 1 and 2, shown applied to the surfaces of the top side 22 and a portion of the rear side 20 is a sealing member 32 that is used to seal an air vent (not visible in FIGS. 1 and 2) provided on the top side of the ink cartridge 10 that enables air to enter and exit the cartridge. In some embodiments, the sealing member 32 is printed upon with various indicia, such that the sealing member also functions as a label. Examples of indicia that may be printed upon the sealing member 32 include indications of the cartridge manufacturer, the cartridge model number, the cartridge manufacturing date, and the like. By way of example, the sealing member 32 comprises a thin strip of polymeric material that includes tear slits 34 that facilitate intentional tearing of the sealing member at a predetermined point along its length to expose the vent to the ambient air. The portion of the sealing member 32 that extends from its end 36 to the tear slits 34 therefore comprises a tear-away portion 38 of the sealing member that may be removed by the user prior to use of the cartridge 10.

Figure 3:
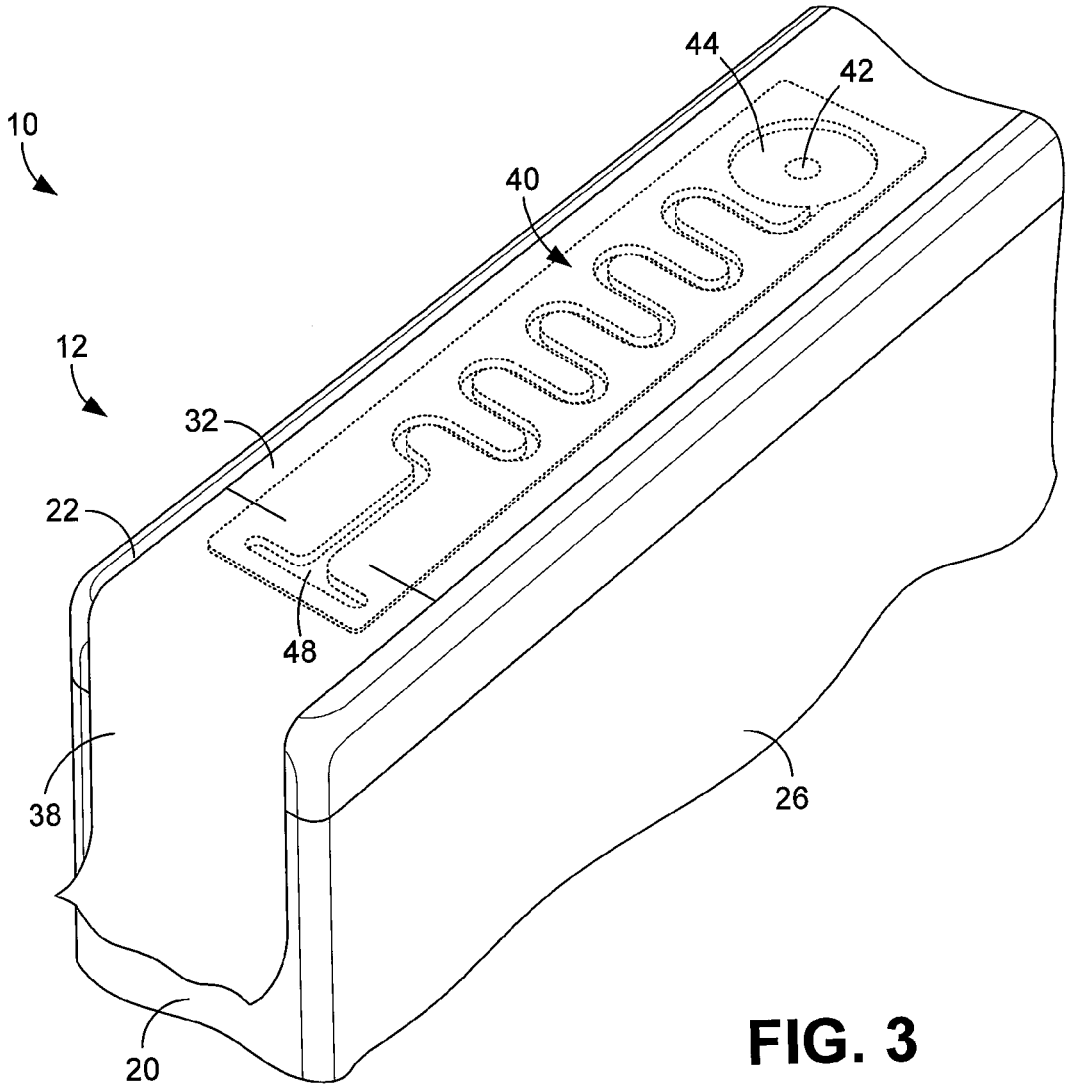
FIG. 3 is a partial rear perspective view of the ink cartridge of FIGS. 1 and 2, illustrating an air vent of the cartridge.

FIG. 3 illustrates an air vent 40 provided on the top side 22 of the ink cartridge 10 underneath the sealing member 32. As shown in FIG. 3, the vent 40 comprises a labyrinth vent that includes a vent opening 42 provided within a circular recess 44 that is in fluid communication with an elongated vent channel that terminates in a T-shaped end 48, which is exposed when the tear-away portion 38 of the sealing member 32 is removed by the end user.

Figure 4:
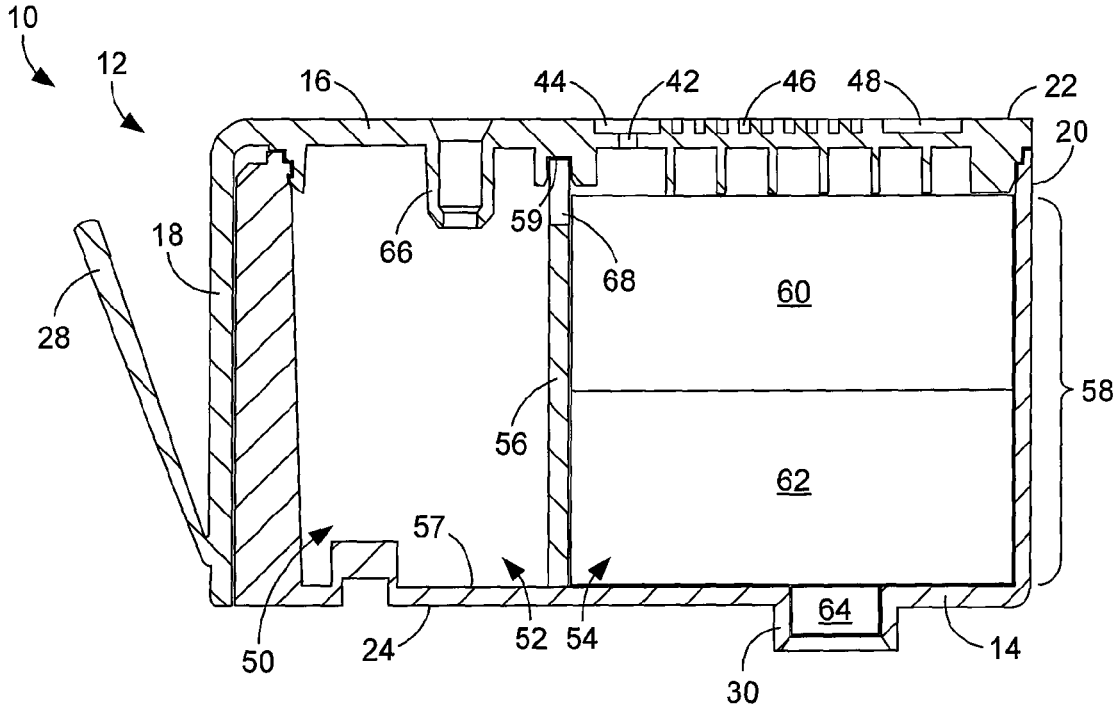
FIG. 4 is a cross-sectional view of the ink cartridge of FIGS. 1 and 2, illustrating a first embodiment of a dividing wall provided within the cartridge.

FIG. 4 illustrates the ink cartridge 10 in cross-section. As can be appreciated from FIG. 4, the cartridge 10 forms an interior space 50 that is separated into a first or front chamber 52 and a second or rear chamber 54 by a dividing wall 56. By way of example, the front chamber 52 comprises approximately one third of the volume of the interior space 50 and the rear chamber 54 comprises approximately two thirds of the volume. The dividing wall 56 extends from an inner surface 57 of the body 14 that forms a bottom surface of the interior space 50 to an inner surface 59 of the lid 16 that forms a top surface of the interior space. Provided within the rear chamber 54 is an ink retaining element 58 that naturally draws in liquids, such as ink, through capillary action. During manufacturing, the ink retaining element 58 is filled with ink that can be supplied to a printhead of the printing device in which the cartridge 10 is used. In the illustrated embodiment, the ink retaining element 58 comprises a first or lower capillarity portion 60 that naturally draws in liquid, but to a lesser degree than a second or higher capillarity portion 62 positioned below the low capillarity portion. By way of example, each portion 60, 62 comprises a mass of fibrous material, such as polyolefin fibers, or a foam member. As is further shown in FIG. 4, the cartridge 10 also includes a wick 64 that is provided within the ink outlet 30. The wick 64 is placed in contact with the high capillarity portion 62 of the ink retaining element 58 and, for example, is constructed of a high capillarity material.

Figure 5:
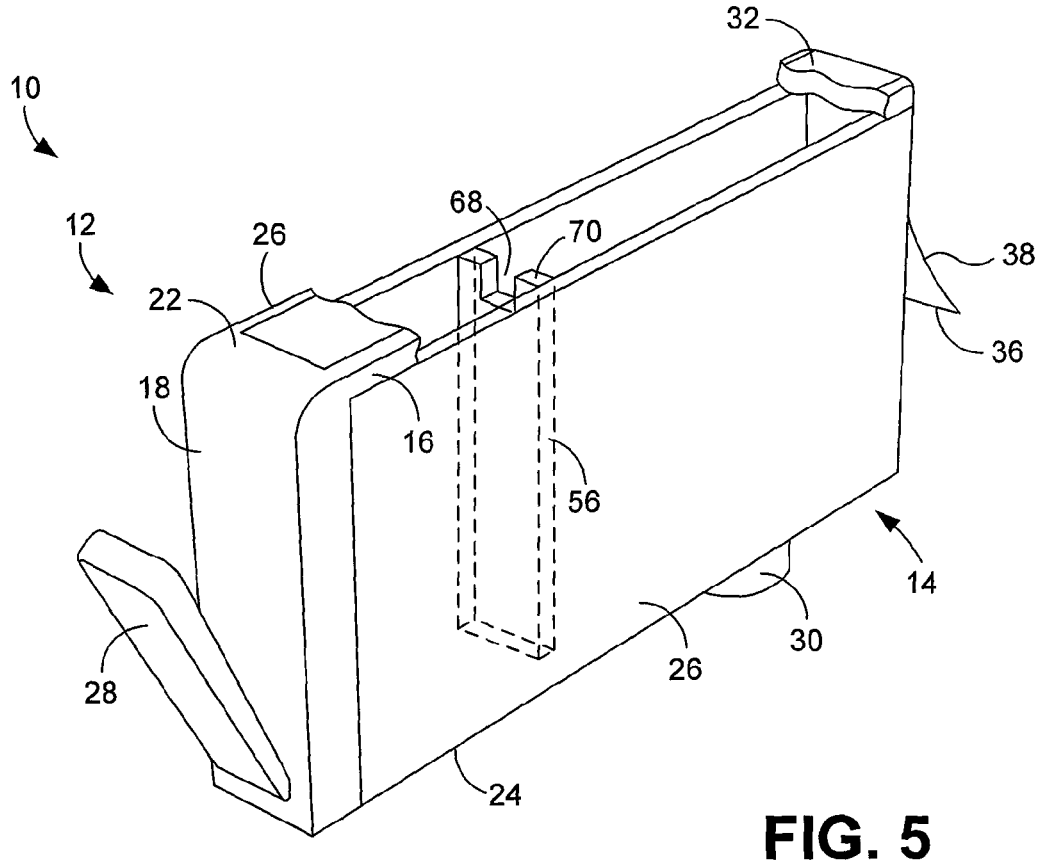
FIG. 5 is a cut-away front perspective view of the ink cartridge of FIG. 4.

The front chamber 52 defines a free space that could be filled with ink via a filling port 66 provided in the lid 16. However, when a partial fill ink cartridge is desired, the front chamber 52 is not filled with ink and therefore contains air. Because the filling port 66 is sealed during manufacturing, that air cannot escape from the cartridge 10 via the filling port when it expands due to reduced atmospheric pressure. However, as indicated in FIGS. 4 and 5, the dividing wall 56 includes an opening 68 in the form of a notch provided at a top end 70 of the wall that forms a passage that permits air to pass without obstruction from the front chamber 52, in the rear chamber 54, and out from the cartridge 10 through the vent opening 42, which coincides with the rear chamber 54. That air can therefore circumvent the ink retaining element 58 FIG. 4). Significantly, the provision of the opening 68 enables integrity testing of the cartridge 10 prior to filling. Specifically, the cartridge 10 can be tested by delivering air under pressure to the interior space 50 via the filling port 66 and measuring the pressure decay over a fixed time interval to evaluate the integrity of the connection (e.g., weld) between the lid 16 and the body 14. Because of the opening 68, the pressurized air can flow from into the rear chamber 54 so that the seal between the lid 16 and the body 14 at the rear end of the cartridge 10 can be checked.

Figure 6:
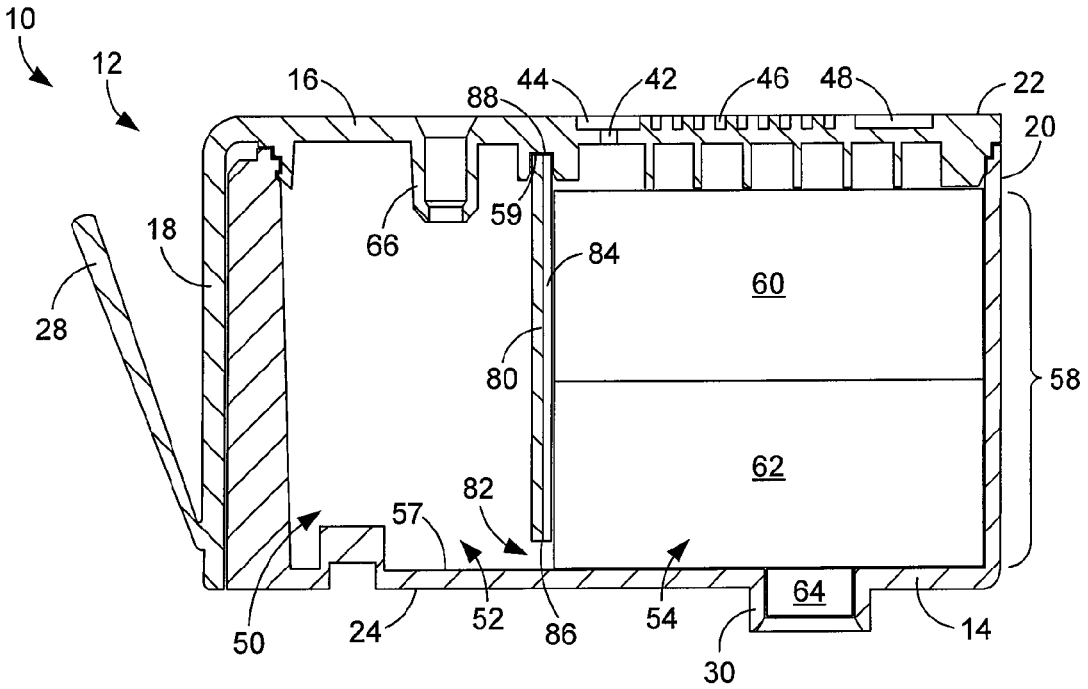
FIG. 6 is a cross-sectional view of the ink cartridge of FIGS. 1 and 2, illustrating a second embodiment of a dividing wall provided within the cartridge.
Figure 7:
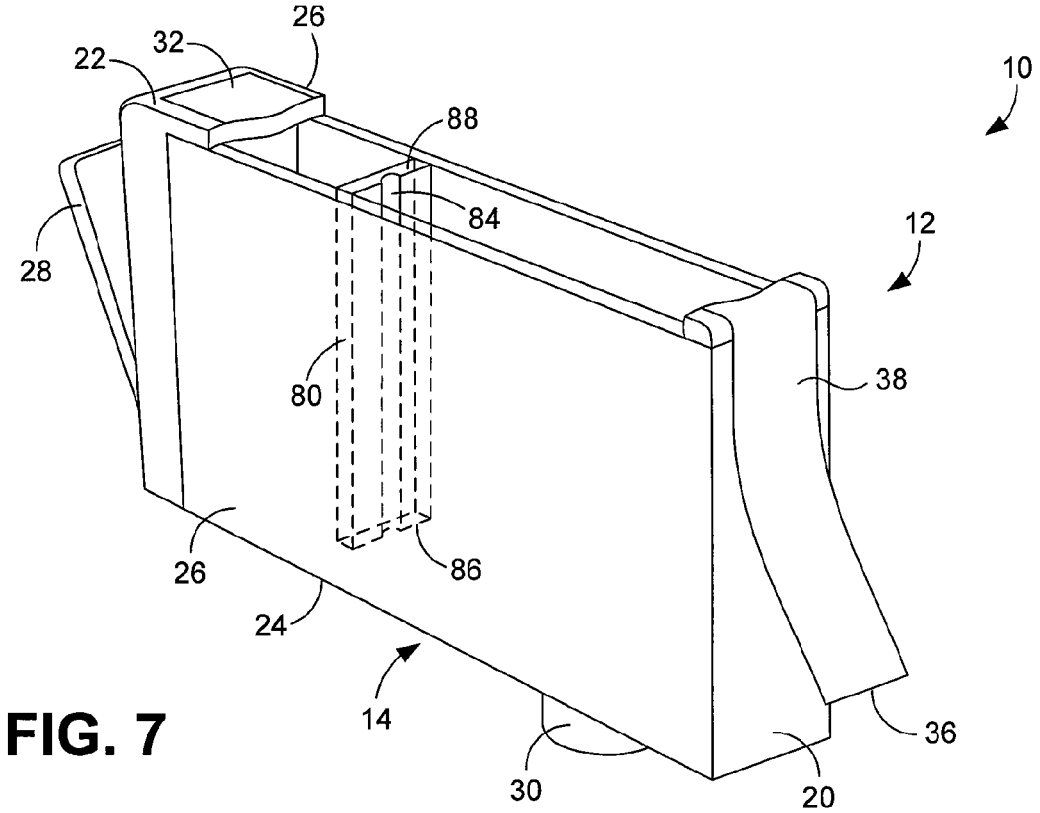
FIG. 7 is a cut-away rear perspective view of the ink cartridge of FIG. 6.

FIGS. 6 and 7 illustrate an alternative embodiment for the ink cartridge 10. As indicated in those figures, the cartridge 10 is largely the same as that indicated in FIGS. 4 and 5. The cartridge 10 in FIGS. 6 and 7, however, comprises an alternative dividing wall 80. Unlike the dividing wall 56, the dividing wall 80 does not extend all the way down to the inner bottom surface 57 of the body 14 and, therefore, forms a passage 82 through which air from the front chamber 52 can pass. In addition, the dividing wall 80 comprises an elongated groove 84 that extends from the bottom end 86 of the wall, and therefore the passage 74, to the top end 88 of the wall. As can be appreciated from FIG. 6, provision of the groove 84 provides space between the dividing wall 80 and the ink retaining element 58 for the air leaving the front chamber 52 through the passage to reach the vent opening 42.

Figure 8:
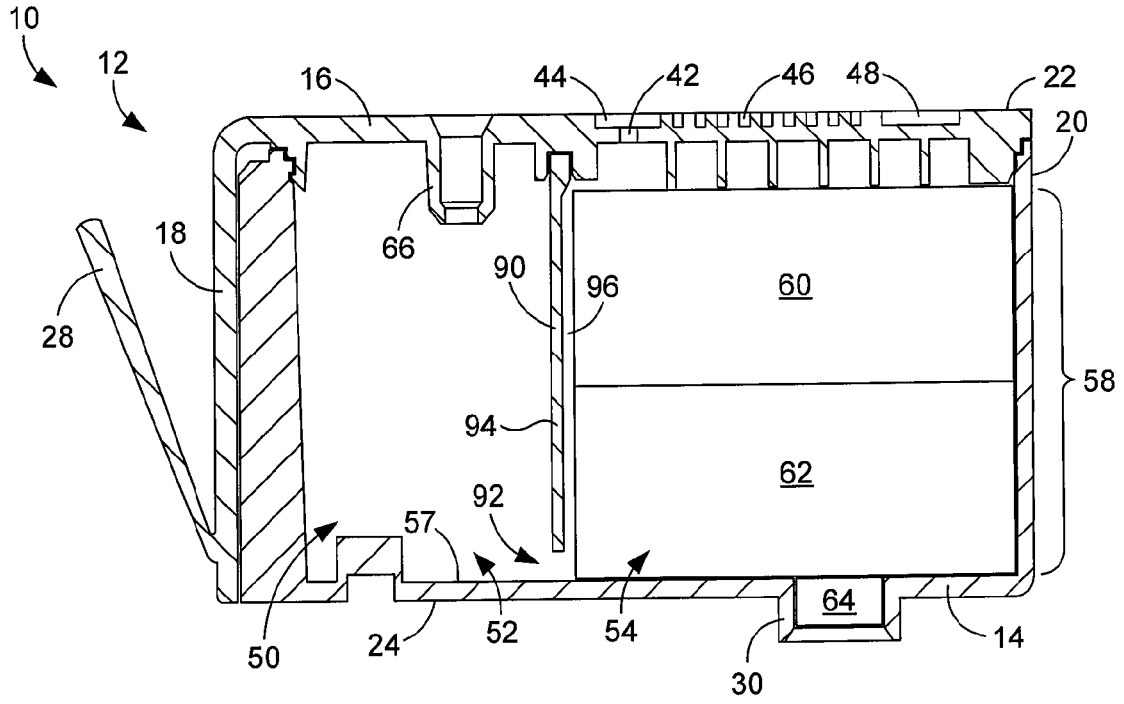
FIG. 8 is a cross-sectional view of the ink cartridge of FIGS. 1 and 2, illustrating a third embodiment of a dividing wall provided within the cartridge.

FIG. 8 illustrates a further alternative embodiment for the ink cartridge 10. As indicated in that figure, the cartridge 10 comprises a dividing wall 90 that, like the dividing wall 80, does not extend all the way down to the inner bottom surface 57 of the body 14. The wall 90 therefore forms a similar passage 92 through which air from the front chamber 52 can pass. Instead of a groove, however, the dividing wall 90 comprises a narrowed portion 94 that forms a gap 96 between the wall and the ink retaining element 58 to enable the air leaving the front chamber 52 to flow to the vent opening 42.

Figure 9:
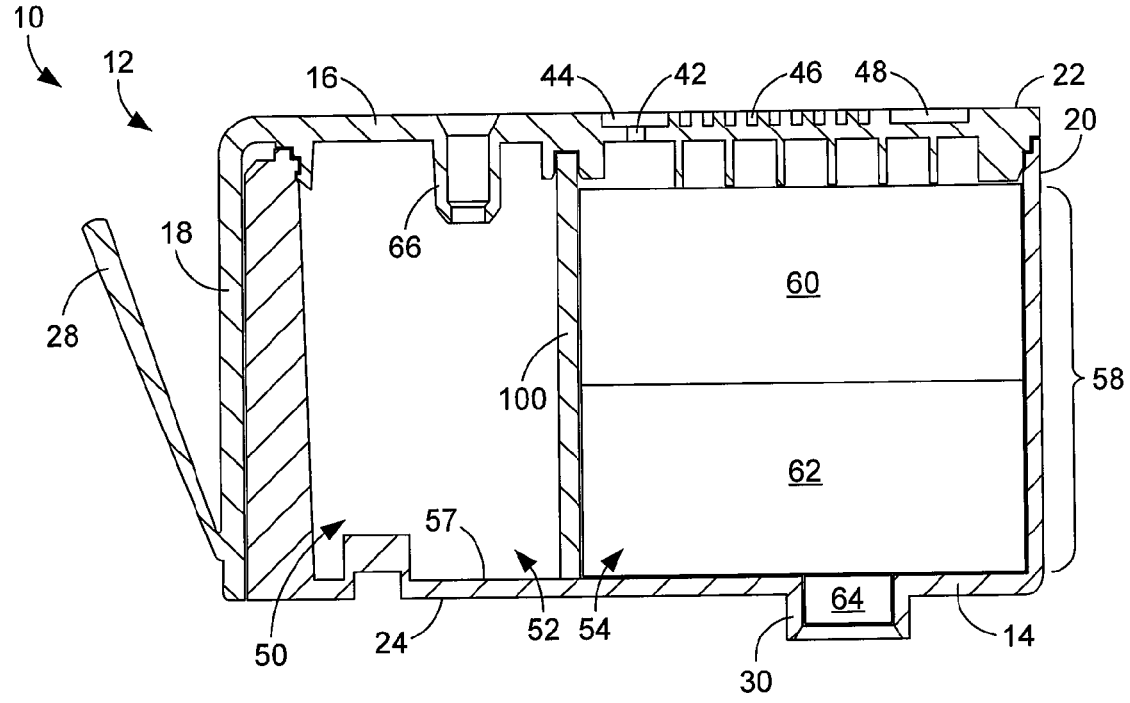
FIG. 9 is a cross-sectional view of the ink cartridge of FIGS. 1 and 2, illustrating a fourth embodiment of a dividing wall provided within the cartridge.

FIG. 9 illustrates yet another alternative embodiment for the ink cartridge 10. As indicated in that figure, the cartridge 10 comprises a dividing wall 100 that extends from the inner bottom surface 57 of the body 14 to the inner surface 59 of the lid 16 and comprises no features through which air can flow between the chambers 52, 54. Accordingly, the wall 100 completely segregates the front chamber 52 from the rear chamber 54 so that air that could cause ink drool cannot pass from the front chamber to the rear chamber. When such a wall 100 is employed, an additional air vent (not shown) may be provided for the front chamber 52 to enable air within the front chamber to flow into and out of the chamber as atmospheric conditions change.

The invention claimed is:

1. A printing fluid cartridge comprising:

an outer housing that defines an interior space to contain ink and has an air vent to enable air to pass out of the interior space:

a removable seal covering an exterior opening of the air vent; and a dividing wall provided within the interior space, the dividing wall separating the interior space into a first chamber and a second chamber, in which the dividing wall seals the first chamber from the second chamber with the exception of a passage, wherein a length of the passage is greater than a thickness of the dividing wall such that the passage slows transit of gas between the first and second chambers, in which a majority of a volume of the second chamber is occupied by a gas and the first chamber is between the second chamber and the air vent.

2. The cartridge of claim 1, further comprising:

a first printing fluid retaining element in a first portion of the first chamber; and a second printing fluid retaining element in a second portion of the first chamber, in which the first printing fluid retaining element has a greater affinity for printing fluid than the second printing fluid retaining element.

3. The cartridge of claim 2, in which, when the cartridge is oriented for use, the first printing fluid retaining element is below the second printing fluid retaining element.

4. The cartridge of claim 2, in which the printing fluid retaining elements are selected from a group comprising: fibrous material and foam..

5. The cartridge of claim 1, in which the vent comprises a third chamber between the interior space and the removable seal.

6. The cartridge of claim 5, in which the third chamber is circular.

7. The cartridge of claim 1, in which the length of the passage is orthogonal to the thickness of the dividing wail.

8. The cartridge of claim 1, in which the vent comprises a plurality of turns.

9. The cartridge of claim 1, in which the vent comprises a T-junction.

10. The cartridge of claim 1, in which a travel path for gas in the vent is longer than a thickness of the outer housing.

11. The cartridge of claim 1, in which the vent comprises a turn such that ejected ink droplets are deposited on an interior surface of the vent.

12. The cartridge of claim 1, in which a cross section of the passage orthogonal to the length is smaller than the thickness of the dividing wall.

13. The cartridge of claim 1, further comprising a plurality of baffles in the interior space configured so as to slow release of gas from the interior space.

14. The cartridge of claim 1, in which the first chamber is substantially filled with ink and the second chamber is substantially filled with gas.

15. The cartridge of claim 1, in which the removable seal comprises tear slits.

16. The cartridge of claim 1, in which the removable seal forms a surface of a portion of the vent.

17. A cartridge comprising:

an outer housing that defines an interior space to contain printing fluid and has a vent to enable gas to pass out of the interior space;

a removable seal covering an exterior opening of the vent; and a dividing wall provided within the interior space, the dividing wall separating the interior space into a first chamber and a second chamber, in which the dividing wall seals the first chamber from the second chamber with the exception of a passage;

wherein the outer housing comprises a labyrinth vent in fluid communication with the vent the labyrinth vent being covered by the removable seal, and in which a majority of a volume of the second chamber is occupied by a as and the first chamber is between the second chamber and the air vent.

18. The cartridge of claim 17, the labyrinth vent further comprising:

a circular recess in which is disposed the exterior opening of the vent; and a serpentine passageway in communication with the circular recess.

19. A cartridge comprising:

an outer housing that defines an interior space to contain printing fluid and has a vent to enable gas to pass out of the interior space;

a removable seal covering an exterior opening of the vent; and a dividing wall provided within the interior space, the dividing wall separating the interior space into a first chamber and a second chamber, in which the dividing wall seals the first chamber from the second chamber with the exception of a passage, wherein a length of the passage is not less than a height of the dividing wall such that the passage slows transit of gas between the first and second chambers.

20. The cartridge of claim 19, in which a portion of a wall of the passage is formed by a printing fluid retaining element.

* * * * *